United States Patent [19]

Sigle et al.

[11] 4,240,214

[45] Dec. 23, 1980

[54] FOOT-SUPPORTING SOLE

[76] Inventors: Rolf Sigle; Jakob Sigle, both of Friedrich-Siller-Strasse 36, D 7014 Kornwestheim, Fed. Rep. of Germany

[21] Appl. No.: 918,089

[22] Filed: Jun. 22, 1978

[30] Foreign Application Priority Data

Jul. 6, 1977 [DE] Fed. Rep. of Germany ..... 7721149
Jan. 12, 1978 [DE] Fed. Rep. of Germany ..... 2801118

[51] Int. Cl.[3] ..... A43B 13/12; A43B 13/14; A43B 13/38

[52] U.S. Cl. ..... 36/30 R; 36/31; 36/32 R; 36/43; 128/586; 128/595

[58] Field of Search ..... 36/30 R, 31, 32 R, 43, 36/44, 25; 128/586, 595

[56] References Cited

U.S. PATENT DOCUMENTS

| | | | |
|---|---|---|---|
| 1,167,885 | 1/1916 | Carll | 36/32 R |
| 1,432,961 | 10/1922 | Brown | 36/32 R |
| 1,636,044 | 7/1927 | Connelly | 36/30 R |
| 2,190,568 | 2/1940 | Lattemann | 128/586 |
| 2,318,926 | 5/1943 | Daniels | 36/43 |
| 2,351,323 | 6/1944 | Daniels et al. | 128/586 |
| 2,897,611 | 8/1959 | Schaller | 36/30 R |

FOREIGN PATENT DOCUMENTS

| | | | |
|---|---|---|---|
| 263576 | 7/1968 | Austria | 36/32 R |
| 182668 | 3/1918 | Canada | 36/43 |
| 588504 | 12/1959 | Canada | 36/43 |
| 98225 | 6/1964 | Denmark | 36/44 |
| 418837 | 9/1925 | Fed. Rep. of Germany | 36/43 |
| 847716 | 8/1952 | Fed. Rep. of Germany | |
| 1000716 | 1/1975 | Fed. Rep. of Germany | 36/43 |
| 1408416 | 7/1965 | France | 36/32 R |
| 37662 | 7/1967 | German Democratic Rep. | 36/43 |
| 452492 | 5/1935 | United Kingdom | 36/43 |
| 611344 | 10/1948 | United Kingdom | 36/44 |
| 878369 | 9/1961 | United Kingdom | 36/43 |

*Primary Examiner*—James Kee Chi

[57] ABSTRACT

To improve the walking motion of the foot in the area of the big toe, a foot-supporting sole features a rigid section which, in the area of the little toe extends further forward than in the area of the hallux ball.

16 Claims, 15 Drawing Figures

Figures 1, 2:
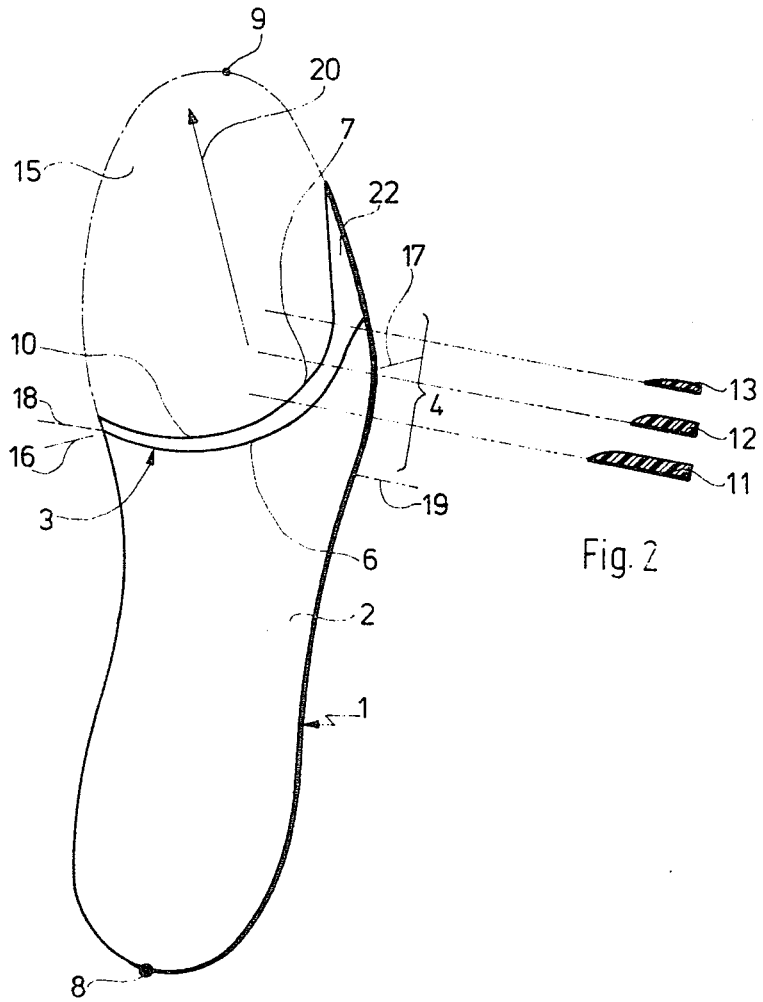

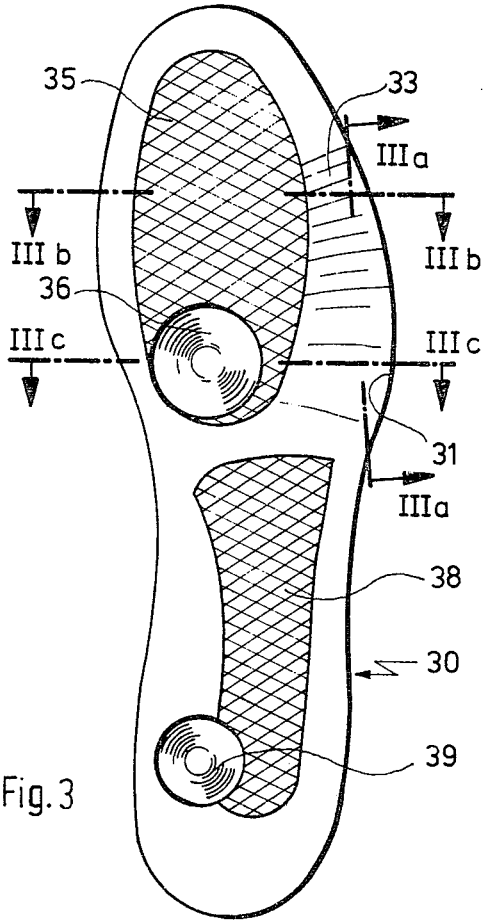
Fig. 3
Fig. 3 b
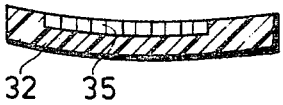
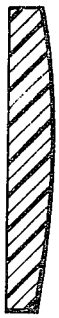
Fig. 3a
Fig. 3c
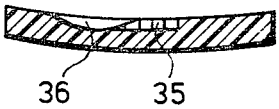
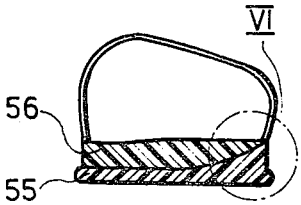
Fig. 5
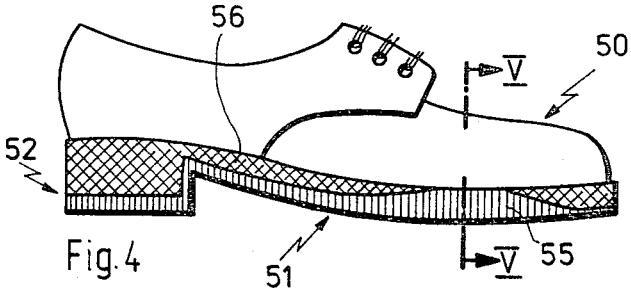
Fig. 4
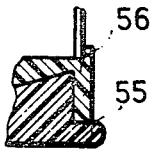
Fig. 6

FOOT-SUPPORTING SOLE

The present invention relates to a foot-supporting sole comprising an essentially rigid section which extends forward into the area of the hallux ball.

With customary footwear, frequently pathological changes occur in the area of the hallux ball, which show as a marked oblique position of the big toe. To partially correct or relieve pathological deformities of the foot, for example foot-supporting soles for partially correcting flat foot and spread foot are known, however these have no effect on the above-mentioned ailments of the ball of the big toe. Known foot-supporting soles comprise an essentially rigid section preferably extending from the heel in a forward direction, which ends in the area of the hallux ball and whose front contour is approximately transverse to the foot longitudinal direction or, within the area of the foot outside, i.e. within the area of the small toe, does not extend as far to the front as it does within the area of the hallux ball. Essentially rigid in this context means that the supporting function of the sole is fully ensured that, however, for the purpose of preventing any load peaks acting on the foot, a slight flexibility of the sole can be provided for, particularly also in the marginal area.

The present invention is based on the object to design a sole of the type initially described in such a manner that it is suitable for preventing the mentioned ailments in the area of the ball of the big toe or for use as a post-operative aid after an operation of the hallux ball. It was found that the described ailments of the hallux ball can be relieved or prevented when it is ensured that the big toe is well bent during walking so that the hallux joint is continuously exercised and does not degenerate due to the lack of strain.

The described problem is solved in accordance with the invention by extending the rigid section within an area spaced from the hallux ball area toward the foot outside further to the front than in the area of the ball of the big toe.

The present invention is advantageous in that such a configuration of the sole prevents the walking motion of the foot to be carried out mainly over its outside thereby abnormally stressing the hallux joint, so that the walking motion is thus extended to include the big toe. The big toe joint will thus be loaded and moved in a natural manner and the initially described ailments can be avoided or at least relieved.

It is particularly advantageous if in accordance with an embodiment of the invention the rigid section at least in the area of the foot outside of the sole extends further to the front than in the area of the hallux ball. This will particularly effectively prevent the walking motion of the foot from extending to the small toe.

It may be sufficient if the rigid section only extends further to the front in the area of the foot outside, i.e. in the area of the small, i.e. the fifth toe, it may, however also be suitable to not make the area within which the rigid section extends further to the front too narrow, so that it extends forward, for example also over the width of at least one additional toe adjacent to the fifth toe.

The object in accordance with the invention is already solved if the rigid section extending further to the front extends forward over the area of the toe balls of, for example, the fifth and fourth toe, in which case even with this rigid section extending only slightly beyond the toe balls, the walking motion is already deflected extending to the big toe. It is particularly advantageous, however, if the rigid section extends considerably forward beyond the area of the mentioned toe balls. An embodiment of the invention provides for an extension of the rigid section at the foot outside of the sole of approximately 15 percent of the foot length for which the sole is dimensioned further to the front than in the area of the hallux ball. This is based on the assumption that the sole length from the heel to the end of the rigid section in the area of the ball of the big toe amounts to approximately 57 percent of the foot length, hence the remaining length from the hallux ball to the tip of the foot amounts to 43 percent and from this remaining length approximately one third is used for the portion of the rigid section extending further to the front in the case of said embodiment. Such a dimensioning leads to optimum results, regardless of the fact that the toe length/total foot length ratio of individual persons is not exactly identical. Such a foot-supporting sole can therefore be manufactured in mass production and used in shoes outside or inside the lasting allowance. It is, however, possible and may be advisable in many cases to manufacture a foot-supporting sole in accordance with the invention as a special model adapted to a certain foot.

It is possible, similar to known foot-supporting soles, to design the front edge of the rigid section essentially straight. In another embodiment of the invention the front edge includes at least one straight portion. In a preferred embodiment of the invention the front edge includes at least one curved portion. The contour of the front edge, which does not include any corners, can be produced in a particularly simple manner, for example also on a skiving machine equipped with a bell-shaped knife.

An embodiment of the invention provides for a section of reduced rigidity following the rigid section. This section of reduced rigidity may preferably provide for a gradual transition from high to reduced rigidity, for example in such a manner that the sole is of decreasing thickness within this section and consists of a material which is of adequate flexibility at reduced thickness. The advantage is that a sharp bend in the shoe can be avoided and that due to the decreasing thickness of the sole annoying step can be prevented in its front section.

The section of reduced rigidity which, however, is not fully flexible, extends in an embodiment of the invention in the area of the foot outside of the sole considerably beyond the rigid section, namely approximately 15 percent of the foot length in the case of an embodiment. Thus the deflection of the walking motion extending to the big toe can be assisted in a favourable manner.

The foot-supporting sole can also be so designed that it ends at the front edge of the rigid section or at the front edge of the section of reduced rigidity, respectively, so that the sole will not extend into the area of the big toe. It is, however, possible to provide a flexible section following the rigid section or the section of reduced rigidity, respectively, so that the sole as a whole has approximately the contour of a foot. This flexible section can, for example, be made of leather, which is connected to the remaining section of the sole in a suitable manner, or of an insole material based on cellulose, which is commercially available as Bontex or Texon.

The foot-supporting sole may also be made from a suitable injection-moulded plastic material, with the sole as a whole having again approximately the contour of a foot. The sole section of reduced rigidity may be provided with recesses which, on the one hand result in savings in weight and material and, on the other hand, permit the desired thickness of the sole in that section in which it is to be relatively flexible. This may be advantageous if the rigid section of the sole is realized by selecting a greater material thickness and if the sole in the remaining, more flexible sections is not to be considerably thinner. The recesses may form a honeycomb pattern.

The sole may be designed as an innersole or as a middlesole or as an insole; in the latter case it is integrated in the shoe. In an embodiment of the invention the sole comprises a wear-resistant layer serving as an outsole. In this case, the sole is not located within the shoe but on its bottom.

According to an embodiment of the invention the wear-resistant layer for achieving different rigidity in the various sections is of varying thickness. The wear-resistant layer of non-uniform thickness can preferably be produced by injection moulding. The wear-resistant layer of the above-described type can, for example, be bonded to the bottom surface of the very thin and flexible sole of a moccasin and thus renders the moccasin more robust and provides for a foot-supporting function of the moccasin sole. In another embodiment of the invention at least one additional layer of reduced ridigity is applied to the wear-resistant layer which additional layer can also preferably be applied by injection moulding. This is advantageous in that the wear-resistant layer whose material is relatively rigid and also relatively expensive can be made thin, with the wear-resistant layer being made of greater thickness for example only in those sections which are subject to excessive wear and where a higher rigidity shall be provided. The additionally applied layer can serve the purpose to achieve that thickness of the complete sole that is customary for a shoe and in addition, as already mentioned above, to compensate for excessive thickness variations of the wear-resistant layer, where necessary.

The transition from an essentially rigid section to a flexible section can, according to an embodiment, be also effected by ray-pattern grooves originating from the hallux ball, which are provided in the forefoot section of the sole. This can also enable the correct walking motion of the foot. It is possible to dispose the grooves in the bottom surface only or also in the upper surface, with the lower and upper grooves being offset relative to each other, if desired. Until now, a soft material had to be used because of the required flexibility and to compensate for the associated elasticity of compression, excessive profiling was necessary. In the unstrained condition, the profile was therefore too high, thus causing swelling and congestion of sensitive feet. The soles in accordance with the invention as described further above do also not expand in the unloaded condition so that also in the case of these soles in the unloaded condition, for example with the person sitting, there is no danger of foot swelling.

In an embodiment of the invention the sole has a greater thickness in the area of the small toe than in the area of the ball of the hallux. This causes the foot within the area of the small toe to be located slightly higher than within the area of the big toe so that the walking motion extending to the big toe is effectively supported and the weight is so distributed to the toe balls as corresponds to the natural development of the thickness of a foot.

Further characteristics and advantages of the invention result from the following description of embodiments of the invention by way of the drawing which shows essential elements of the invention and from the claims. The single elements can either individually or in combination of several elements be realized in an embodiment of the invention.

In the drawings

FIG. 1 is a top view of an embodiment of a sole in accordance with the invention, designed as an insole, in which the sections of different rigidity are indicated by differently hatched areas, FIG. 2 shows several vertical sections through the sole in accordance with FIG. 1, with the location of the sections being indicated by lines connected with FIG. 1, FIG. 3 is a top view of another embodiment of a sole in accordance with the invention, designed as an outsole, where the increased rigidity of the foot outside is achieved by a greater thickness of the sole as indicated in the drawing, FIGS. 3*a*, 3*b* and 3*c* are sections taken along line III*a*, III*b* and III*c*, respectively, in FIG. 3.

Figure 7:
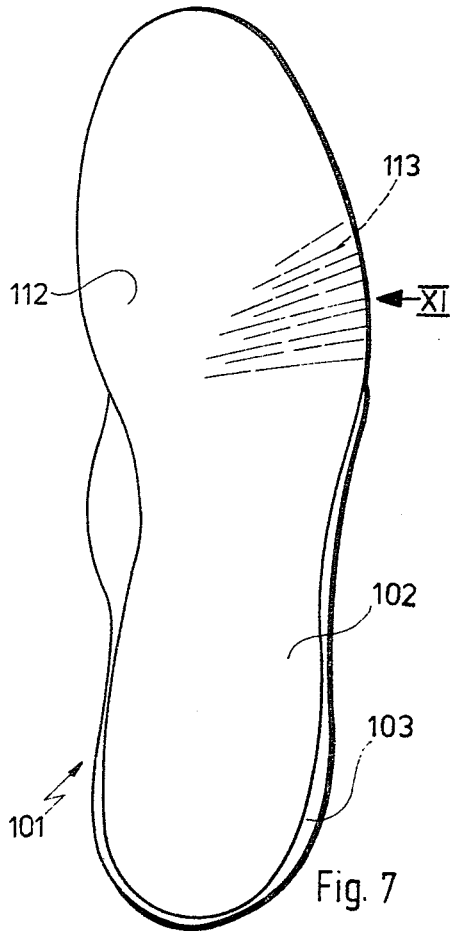
Figure 8:
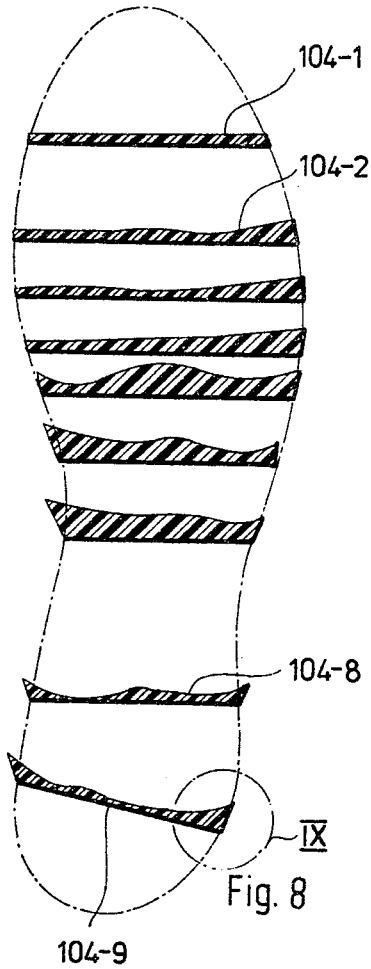
Figure 9:
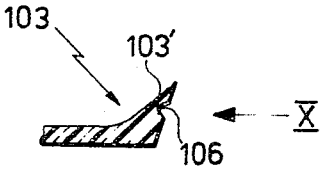
Figure 10:
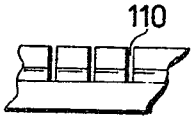
Figure 11:
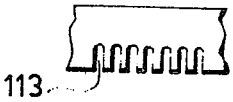
Figure 11A:
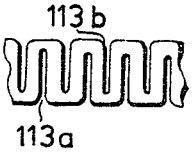

FIG.4 is a side view of a right foot shoe comprising a double-layer sole in accordance with another embodiment of the invention, which is designed here as an injected bottom, i.e. as an outsole with heel, FIG. 5 is a section taken along line V—V in FIG. 4, FIG. 6 shows detail VI in FIG. 5 at a larger scale, FIG. 7 is a top view of another embodiment of an innersole or insole in accordance with the invention, FIG.8 is the representation of the profile of the sole in accordance with FIG. 7 along several sectional lines, FIG. 9 is the enlarged representation of detail IX in FIG. 8, FIG. 10 is a view in the direction of arrow X in FIG. 9, FIG. 11 is a view in the direction of arrow XI in FIG. 7, FIG. 11*a* is another embodiment viewed in the direction of arrow XI.

In FIGS. 1 and 2 sole 1 has been manufactured by injection moulding from a suitable material, such as polyamide. Other materials such as polyurethane and polyethylene can also be employed. In the heel section thesole can be formed in the known manner and be dish-shaped and in the middle section it can be vault-shaped; these details being not associated with the invention are not shown in the drawing. In FIG. 1 is the top view of the sole for a right foot. Section 2 of sole 1 is essentially rigid. This ridig section 2 in the area of the foot outside, i.e. the side of the foot including the small toe, which is on the right hand side of FIG. 1, extends further to the front than in the area of the ball of the big toe. The margin of rigid section 2 in the area of the hallux ball is identified with reference numeral 3. Section 4 of rigid section 2, which extends further to the front in the area of the foot outside is of decreasing width in the forward direction, as can be seen from FIG. 1, and front margin 6 of rigid section 2 shows a curved contour in the top view. Secion 4 of rigid section 2 has a length of approximately 15 percent of the foot length measured between points 8 and 9, for which foot length sole 1 is intended.

Beginning at line 6, the thickness of sole 1 decreases toward front edge 10 of the plastic section of sole 1, as can be seen from the three sectional views 11 to 13 shown in FIG. 2, and between line 6 and edge 10 the rigidity is reduced as compared to section 2.

Section 7 of reduced rigidity, which is defined by lines 6 and 10, is followed by a flexible front section 15 made, for example, from leather, Bontex, Texon etc., which is connected to the remaining portion of the sole in a manner not shown in detail. The chain-dotted contours of section 15 indicate that this section may as well be omitted, e.g. if sole 1 is to be sewn into the sole of a shoe. Sole 1 without section 15 may, however, also be used as a loose innersole.

In use, sole 1 bends due to section 4 located at the sole outside, which extends to the front in such a manner that a swivel axis approximately along straight line 16–17 can be assumed for the bending motion. This swivel axis still extends within front section 4 of rigid section 2 because due to the width of this section 4 decreasing towards the front, this section has a reduced rigidity as compared to the remaining portion of rigid section 2, although its thickness remains essentially constant. As compared to known foot-supporting soles, reference is made to the fact that in the case of said soles the foot is bent approximately in accordance with a swivel axis which can be drawn by the connecting straight line 18–19 between the broken lines identified by these reference numerals.

This connecting straight line 18–19 extends approximately transversely to the connecting straight line of points 8 and 9, which defines the longitudinal direction of the foot. The connecting straight line of points 8 and 9 does not run through the big toe but between the big toe and the neighboring toe. As is shown in FIG. 1, the swivel axis defined by straight line 16–17 considerably deviates from the direction transverse to the connecting straight line of points 8 and 9 in the case of the sole in accordance with the invention so that the walking motion of the foot effectively extends to include the big toe, which is indicated by arrow 20 extending approximately at right angles to connecting straight line 16–17.

If front section 15 is provided it is preferably of an extremely small thickness and high flexibility.

Section 7of reduced rigidity considerably extends at the foot outside of the sole beyond front section 4 of the rigid portion, namely by approximately the length of section 4 measured in the foot longitudinal direction.

The so resulting extension 22 of reduced rigidity is preferably of a thickness which decreases towards its pointed front end and the length of this extension 22 can also be longer or shorter than in the shown embodiment.

It is considered to be particularly advantageous that sole 1 in the area of section 4 does not only have a considerable rigidity which, for example, could also be provided by a relatively thin but rigid material, but also a considerable thickness so that the foot in the area of the small toe and its associated toe ball and, in the embodiment, also in the area of the neighbouring fourth toe is located slightly higher than the hallux ball which is supported only by the very thin section 15. This raising of the outside of the foot assists in deflecting the walking motion extending to the big toe.

Outsole 30 shown as a top view in FIG. 3 is made from polyvinyl chloride by injection moulding. Other materials, e.g. rubber or polyurethane, i.e. elastic materials suited for injection of vulcanization, could also be employed.

FIG. 3*a* shows the increased thickness of the sole in comparison to other sections of the sole. This section of increased thickness 33 does not extend to the longitudinal centre plane of sole 30, but essentially extends, as is shown in FIG. 3, only within the area of the fourth and fifth toe, i.e. of the two small toes. The section which has to feature a higher flexibility is provided on the upper surface of sole 30 with a honeycomb pattern 35. Within a circular section 36, the surface of sole 30 is somewhat lowered in the area of the hallux ball. Honeycomb pattern 38 and a slightly lowered region 39 for the calcaneum may also be provided. Below honeycomb 35, an approximately 3.5 mm thick layer 32 consisting of solid plastic material is provided. In the case of a total thickness of the sole of e.g. 7 mm, the honeycomb height therefore amounts to 3.5 mm.

Outsole 30 may also comprise in a known manner a longitudinal vault and a transverse vault for supporting the foot, this, however, is not shown in the drawing.

FIG. 4 shows a right shoe with injected bottom (outsole with heel) in a view taken from the right. Shoe 50 comprises an outsole 51 with a moulded heel 52. Outsole 51 comprises a lower wear-resistant and relatively rigid layer 55 which, as is shown in FIGS. 4 and 5, is of increased thickness in the area of the small toe. A softer layer 56 is applied to wear-resistant layer 55, also in the area of the heel, which need not be highly wear-resistant. This additional layer 56 is relatively thick in those sections where wear-resistant layer 55 is thin so that the total thickness of outsole 51 has smaller thickness differences than the thickness of wear-resistant layer 55. But also in this embodiment as shown in FIG. 5, the small toe is located higher than the big toe because the right hand section in FIG. 5 of additional layer 56 is raised in the area of the small toe (right hand side in FIG. 5) as compared to the area of the big toe (left hand side in FIG. 5).

Because additional layer 56 frequently is of a colour different from that of wear-resistant layer 55, additional layer 56 overlaps wear-resistant layer 55 in the marginal area of the sole, as is shown in FIG. 6. Only the lowest portion 59 of the wear-resistant layer is for example not covered by this layer 60 because it protrudes laterally beyond it.

Wear-resistant layer 55 consists of wear-resistant and relatively rigid polyurethane, polyvinyl chloride, rubber or any other suitable material, softer layer 56 consists of the same or another material, however of a softer condition. In FIG. 5 the small toe is raised relative to the big toe by approximately 1 mm. This difference in height of 1 mm in conjunction with the reduced flexibility of the sole is already useful. If required, the difference in height may also be increased and amount to e.g. 2.5 mm.

The innersole which as a whole is identified with reference numeral 101, shown in FIGS. 7 to 11, comprises in a known manner a structural section 102 which, in the area of the heel and the outside of the metatarsal foot area includes a high side portion 103. The contour of the surface of innersole 101 facing the foot can be seen from the various sections 104-1 to 104-9 in FIG. 8. From FIG. 8 the high side portions 103 can be clearly seen which surrounded structural part 102 similar to the rim of a dish.

From the enlarged view of FIG. 9 it can be seen that side portions 103 are provided with a groove-shaped recess 106 over their full length in their outer surface remote from the foot, which cause a weakening of the material so that upper portion 103′ of side portion 103 can relatively easily be bent to the outside. This bending or swivelling motion is elastic, i.e. side portions 103 return to their original shape after the load has been removed. In order to assist the bending motion of upper portion 103' of side portions 103 towards the outside and to additionally enable the bending motion towards the outside to be effected within the various sections of innersole 101 to a varying degree, relatively narrow and essentially vertical cuts 110 are provided as shown in FIG. 10 which, in the case of the embodiment extend to the lower margin of recess 106. These cuts can, for example, be spaced from one another by 10 mm, in the region of the margin of the innersole with maximum curvature in the area of the rear heel end, the distance can also be reduced, if desired.

It may be advantageous to make cuts 110 so wide that there is no possibility for fibres getting caught in the cuts when these spring back to their original position after portions 103' have been bent to the outside which may have caused widening of cuts 110. It may also be advisable to round the edges of the cuts.

As can be seen from FIGS. 7 and 11, innersole 101 in the areas of the forefoot comprises ray-pattern, groove-type indentations 113 originating from area 112 where the ball is located, which are disposed in the bottom of sole 101 and which, in spite of the relatively rigid material of innersole 101, enable a motion of the innersole corresponding to the natural walking motion of the foot.

As shown in FIG. 11*a*, lower grooves 113*a* and upper grooves 113*b* which are laterally offset relative to each other may also be provided, all of which have almost the depth that equals the sole thickness.

Innersole 101 can be cast from a polyamide or polystyrene or polyurethane etc. in accordance with a plaster cast of a foot so that an orthopaedic innersole adapted to the individual foot is obtained. Recess 106 can be produced subsequently either in a chip removing process or by means of a suitable, heated tool in a plastic forming process, but it is also possible to already define the bottom of innersole 101 and its outer side surface with recess 106 by one section of a mould, with the other section of the mould being formed by the positive plaster cast of the foot.

In another embodiment of the invention the last-described foot-supporting sole is, however, an insole for shoes and this insole is factory-made by injection moulding so that an individual adaptation to a certain form of the foot can no longer be achieved. In the case of this production method, i.e. injection moulding, the injection mould is already so designed that is produces recess 106, furthermore, the injection mould can already be so designed that the finished insole already comprises cuts 110 and grooves 113, 113*a*, 113*b*.

The higher rigidity of several sections of the sole can also be achieved by providing the sole in the corresponding sections with embedded intermediate layers consisting of rigid material or sections consisting of rigid material are preferably either bonded or vulcanized to the bottom of the sole.

A major advantage of the invention is that the described favourable properties of the sole can be achieved with material thicknesses as are also customary for known soles. Hence, the sole in accordance with the invention is not thicker than the customary sole.

We claim:

1. A sole for a shoe, said sole comprising a body having a wear resistant layer, said wear resistant layer having a contour at least in part conforming to the shape of the foot and having sections of relatively varying thickness obtaining different rigidity, one of said sections lying generally to the rear of the area of the hallux ball and extending free of the area of the hallux ball along the periphery of the sole along the outside of said foot a distance forward of the hallux ball, said one section being of greater thickness than adjacent sections including the area of the hallux ball to thereby have greater rigidity than said adjacent sections.

2. The sole according to claim 1, wherein said one section extends continuously from the rear of the rear of the hallux ball by approximately 15 percent of the foot length of said sole forwardly of the hallux ball.

3. The sole according to claim 2 including a toe section of reduced rigidity extending forwardly of said one section conforming at least in part to the toe portion of said foot.

4. The sole according to claim 3 wherein said toe section extends forwardly of said one section along the periphery of said sole.

5. The sole according to claim 1, 2, 3 or 4 wherein said body includes a second layer on the inner side of said sole of a rigidity less than that of said wear resistant layer.

6. The sole according to claim 5 wherein said second layer is of varying thickness in selected sections.

7. The sole according to claim 5 serving as an outsole.

8. The sole according to claim 5 serving as an innersole.

9. The sole according to claim 5 wherein said second layer at least in part covers the peripheral edge of said wear resistant layer.

10. The sole according to claim 1 wherein said sole has a greater thickness in the section conforming to the small toe then in the area of the hallux ball.

11. The sole according to claim 3 wherein recesses are provided within the sections of reduced rigidity.

12. The sole according to claim 11 wherein a recess is formed in the area of the hallux ball.

13. The sole according to claim 11 wherein a recess is formed in the area of calcaneum.

14. The sole according to claim 11 wherein said recess is at least in part filled with a layer of material of reduced rigidity.

15. The sole according to claim 1 wherein there is provided a grandual transition in thickness between sections of varying thickness.

16. The sole according to claim 1 wherein a plurality of grooves is formed in the layer of wear resistant material to provide a transition between sections of varying thickness.

* * * * *